United States Patent [19]

Hildebrandt et al.

[11] Patent Number: 4,756,410

[45] Date of Patent: Jul. 12, 1988

[54] APPARATUS FOR KEEPING AND MIXING TWO SUBSTANCES

[75] Inventors: Bodo Hildebrandt, Riedstadt; Franz Steigerwald, Griesheim, both of Fed. Rep. of Germany

[73] Assignee: Wella Aktiengesellschaft, Darmstadt, Fed. Rep. of Germany

[21] Appl. No.: 102,912

[22] Filed: Sep. 29, 1987

[30] Foreign Application Priority Data

Oct. 7, 1986 [DE] Fed. Rep. of Germany ..... 3634079

[51] Int. Cl.[4] ..... B65D 25/08

[52] U.S. Cl. ..... 206/222; 215/DIG. 8

[58] Field of Search ..... 206/219, 221, 222; 215/DIG. 8

[56] References Cited

U.S. PATENT DOCUMENTS

| | | | |
|---|---|---|---|
| 4,177,938 | 12/1979 | Brina | 206/222 X |
| 4,465,183 | 8/1984 | Saito et al. | 206/222 |
| 4,693,366 | 9/1987 | Goncalves | 206/222 |

*Primary Examiner*—William Price

*Attorney, Agent, or Firm*—Michael J. Striker

[57] ABSTRACT

In a container for a first substance, an ampoule, which can be broken while the container is closed, is provided for a second substance. The container has a base and a rotatable cap. The ampoule spike is mounted in the region of the base. An eccentric on the cap is operatively connected to the ampoule that the base of the ampoule moves transversely to the longitudinal axis of the container on turning the cap, and the ampoule is mounted so as to be pivotable about the region of a predetermined breaking point.

10 Claims, 1 Drawing Sheet

APPARATUS FOR KEEPING AND MIXING TWO SUBSTANCES

BACKGROUND TO THE INVENTION

1. Field of Invention

The invention relates to apparatus for keeping and mixing two substances, preferably liquids, the first substance being held directly in a container which also hold an ampoule, which can be broken while the container is closed, for the second substance.

2. Description of Prior Art

For liquids which consist of two different components which are to be mixed only shortly before the liquid is used, containers are known in which an ampoule is provided for keeping one of the liquids inside the container. One of the areas of application of containers of this type is to keep and mix liquid hair dyes.

A container for mixing a plurality of components is known for example from Swiss Patent Specification No. 634007, in which a number of ampoules are provided which can be broken with the aid of a very expensive mechanism. In addition, in the case of an aerosol container, it is known from the German Gebrauchsmuster (Utility Model) G No. 81 34 396 for example, to break an ampoule disposed in the aerosol container by tilting the valve. This known apparatus, however, requires a considerable application of force. In addition, only when the container is subsequently turned over through 180°, can the ampoule be emptied and both substances mixed.

SUMMARY OF THE INVENTION

What is desired is apparatus enabling thorough mixing of both substances with a modest application of force and without following special directions. In this connection the container should be as inexpensive as possible.

The present invention provides apparatus in which the container comprises a base plate and a rotatable cap, a part restricting the movement of the ampoule extension or spike is provided in the region of the base plate, an eccentric disposed on the cap is operatively connected to the ampoule in such a way that the base of the ampoule is movable transversely to, or substantially at right angles to, the longitudinal axis of the container by turning the cap, and the ampoule is mounted so as to be pivotable about the region of a predetermined breaking point.

It is possible to break the ampoule with a modest application of force and the greater part of the contents of the ampoule is emptied into the container without the container having to be inverted. The invention is particularly suitable for non-pressurized containers and preferably for liquids, but it is also suitable for substances in powdered form.

The operative connection between the eccentric and the ampoule is preferably formed by a rail or guideway which is provided on the base of the ampoule and in which the eccentric engages. On account of this, it is possible in particular to secure the container during transport when the ampoule is not yet broken.

A preferred embodiment including an ampoule holding means which at least partly surrounds the ampoule and is connected in an articulated manner to a holding means connected to the base of the container. On account of this further development, secure mounting of the ampoule inside the container is made possible and at the same time the rail or guideway in which the eccentric engages is reliably connected to the ampoule. The articulated connection may be formed by a flexible plate which is part of the ampoule holding means.

The rail or guideway can be part of the ampoule holding means or part of a sleeve embracing the base area of the ampoule.

In order that the broken edges should not strike one another during shaking after the ampoule has been broken, it is preferable to provide a resilient tongue which exerts pressure on the ampoule spike at the predetermined breaking point and is pivotable between the ampoule and the ampoule holding means after the ampoule has been broken.

An advantageous arrangement of the invention consists in that the ampoule is disposed asymmetrically in the container.

In order to prevent the ampoule from being broken by knocks upon the container and to allow the ampoule extension or spike free movement after being broken, the ampoule extension is mounted with a predetermined clearance in the region of the base plate.

In order to facilitate insertion of the ampoule into the container, a part of the ampoule holding means forming the rail or guideway may be hinged.

BRIEF DESCRIPTION OF THE DRAWINGS

In the accompanying drawings, given by way of example.

DETAILED DESCRIPTION OF PREFERRED EMBODIMENT

Figure 1:
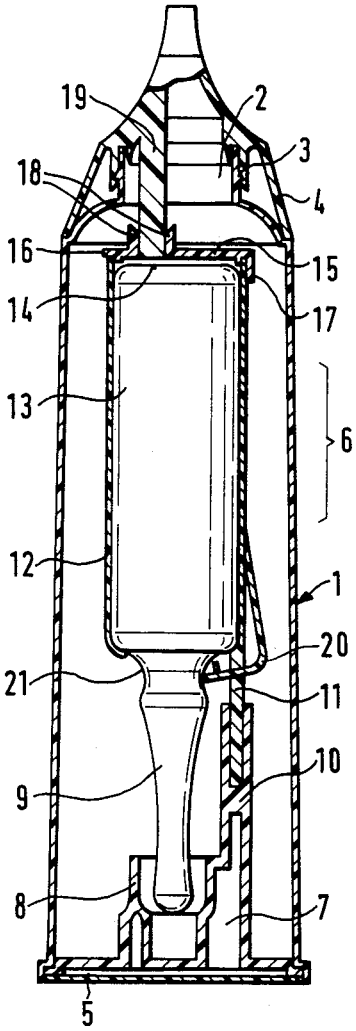
FIG. 1 is a longitudinal section of an embodiment of apparatus according to the invention in the conveying position, i.e. with the ampoule intact.

In the head area of a container 1 the casing forms an opening 2, on the outside of which is formed a continuous bead 3 as an abutment for a rotatable cap 4. In the base area the casing is formed in such a way that it is joined to a base element 5 in a liquid-tight manner, preferably by welding. The casing is preferably adapted to be properly crushed in a gripping region 6. A holding means 7, which embraces an abutment 8 for mounting the ampoule extension or spike 9 and a seat 10 for a flexible plate 11 which is part of an ampoule holding means 12, is disposed on the base plate 5, projecting upwards into the container. The ampoule holding means 12 embraces the ampoule 13 in the manner of a quiver.

In the region of the base 14 of the ampoule 13 the ampoule holding means 12 has a cover 15 which is connected to the rest of the holding means 12 by a film hinge 16 and which is held by a catch 17. The cover 15 is provided with a guideway or rail 18 which extends at right angles to the plane of the drawing. An eccentric 19, which is injection-moulded on the rotatable cap 4, engages in the guideway 18.

Finally, a resilient tongue 20, which exerts pressure on the ampoule spike 9 at the predetermined breaking point 21, is provided integrally on the ampoule holding means 12.

Figure 2:
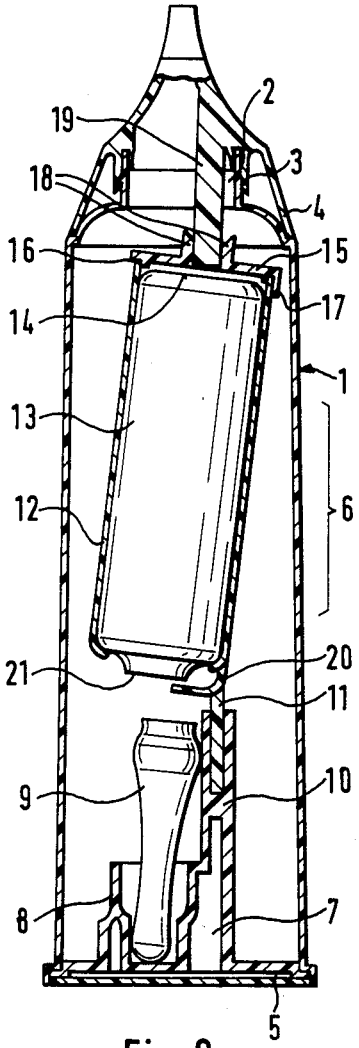
FIG. 2 shows the same apparatus after the ampoule has been broken.

In order to open the ampoule 13 the cap 4 is turned through approximately 180°, until the eccentric 5 occupies the position shown in FIG. 2. In this way the ampoule 13 is tipped to the right, the ampoule spike 9 first striking the left-hand edge of the abutment 8 and the ampoule 13 then being broken at the predetermined breaking point 21. The spike 9 then drops down into the abutment 8. The resilient tongue 20 springs forward slightly and thus lies between the broken edges of the body of the ampoule 13 and the spike 9. This prevents the broken edges from striking one another when the container is shaken.

After the ampoule 13 has been broken, the two substances flow into contact. The substances can be properly mixed by shaking. After unscrewing or otherwise removing the closure of the cap 4, the container can be emptied and where appropriate the mixture can be forced out by crushing the container in the region 6.

We claim:

1. Apparatus for keeping and mixing two substances, comprising a container for containing a first of the substances and an ampoule, inside the container, for containing a second of the substances, the ampoule having a body with a base and an extension which is remote from the base and which can be broken off at a predetermined breaking point, the container comprising a hollow body having a longitudinal axis, a base, and a rotatable cap, a part restricting movement of the ampoule extension provided in the region of the base, and an eccentric disposed on the cap and operatively connected to the ampoule in such a way that the base of the ampoule is movable transversely to the longitudinal axis of the body of the container by turning the cap, and the ampoule being mounted so as to be pivotable about the region of the predetermined breaking point.

2. Apparatus as claimed in claim 1, including a guideway which is provided on the base of the ampoule and in which the eccentric engages, thereby providing an operative connection between the eccentric and the ampoule.

3. Apparatus as claimed in claim 2, in which the guideway is part of a sleeve embracing the region of the base of the ampoule.

4. Apparatus as claimed in claim 1, including an ampoule holding means which at least partly surrounds the ampoule, a holding means connected to the base of the container, and an articulated connection between the two holding means.

5. Apparatus as claimed in claim 4, in which the articulated connection comprises a flexible plate which is part of the ampoule holding means.

6. Apparatus as claimed in claim 4, including a guideway forming part of the ampoule holding means, the guideway being adjacent the base of the ampoule and being engaged by the eccentric, thereby providing an operative connection between the eccentric and the ampoule.

7. Apparatus as claimed in claim 1, including a resilient tongue which exerts pressure on the predetermined breaking point and is pivotable between the ampoule body and the ampoule extension after the ampoule has been broken.

8. Apparatus as claimed in claim 1, in which the ampoule is disposed asymmetrically in the container.

9. Apparatus as claimed in claim 1, including means for mounting the ampoule extension with a predetermined clearance in the region of the base of the container.

10. Apparatus as claimed in claim 6, in which the part of the ampoule holding means forming the guideway is hinged.

* * * * *